United States Patent [19]

Forsell

[11] 4,202,376

[45] May 13, 1980

[54] CLOSING CAP ON WELL CASINGS IN WELL OPENINGS

[75] Inventor: Bror I. Forsell, Göthenburg, Sweden

[73] Assignee: RP Rorprodukter AB, Göthenburg, Sweden

[21] Appl. No.: 942,116

[22] Filed: Sep. 13, 1978

[30] Foreign Application Priority Data

Oct. 26, 1977 [SE] Sweden ..... 7712037

[51] Int. Cl.[2] ..... F16L 55/00

[52] U.S. Cl. ..... 138/89; 138/96 R; 166/75 A

[58] Field of Search ..... 138/89, 96 R, 109, 112; 174/74 A, 93; 166/75 A, 75 R

[56] References Cited

U.S. PATENT DOCUMENTS

| | | | |
|---|---|---|---|
| 1,705,159 | 3/1929 | Rouse | 174/74 A |
| 3,476,671 | 11/1969 | Petty | 174/74 A |
| 4,015,072 | 3/1977 | Gillemot | 174/93 |
| 4,077,472 | 3/1978 | Gano | 166/75 A |

*Primary Examiner*—Lenard A. Footland
*Attorney, Agent, or Firm*—Ernest A. Beutler

[57] ABSTRACT

A cap intended to close the upper end of a well casing arranged in a well opening. The closing cap is provided with upright sleeves for passage therethrough of tubes, pipes, and the like from the well pump. An annular shoulder is formed on the internal wall of the cap, allowing the cap to be mounted in a sealing position on well casings with different dimensions. Tapering sections on the upper edges of the sleeves provide for automatic sealing-off of the sleeves around its associated tube etc.

1 Claim, 4 Drawing Figures

CLOSING CAP ON WELL CASINGS IN WELL OPENINGS

BACKGROUND OF THE INVENTION

To prevent surface water and foreign objects from penetrating into a drilled well provided with a well casing, a closing cap is as a rule mounted over the upper end of the casing, said cap equipped with sleeves which extend upwards from the upper part of the cap and through which pass tubes or pipes from the pump that is immersed in the well opening. The pump is suspended in a wire or a chain, the upper end of which is secured in a loop which in turn is secured in a steel plate which is moulded into the upper part of the cap. The latter is made from rubber or other elastic material. Hose clamps are provided to tighten the sleeves sealingly about their associated tube and a hose clamp is likewise provided to tighten sealingly the downwardly projecting wall of the cap about the upper end of the well casing.

In general, well opening casings of two different dimensions are available on the market, viz. one well casing having an external diameter of 125 mm and one with an external diameter of 140 mm. Each casing dimension requires a closing cap of corresponding dimensions. For this reason, it has hitherto been necessary to stock closing caps of two different dimensions. The purpose of the subject invention is to remedy this drawback.

SUMMARY OF THE INVENTION

It is characteristic of the invention that close to its middle the cap wall is formed with an annular shoulder allowing the lower wall portion of the cap to be arranged in a sealing position on a well casing which has a predetermined external diameter, alternatively, the upper wall portion to be arranged in a sealing position on a well casing which has a smaller external diameter. Owing to this design of the cap wall one and the same cap may be used for two well casings of different dimensions.

In accordance with a preferred embodiment, defined in the appended claim 2, no hose clamps are required to tighten and seal-off the upright sleeves about their associated tube. This simplifies mounting and reduces the costs of the closing cap.

BRIEF DESCRIPTION OF THE DRAWINGS

The invention will be described in closer detail in the following with reference to the accompanying drawing, wherein.

DETAILED DESCRIPTION OF A PREFERRED EMBODIMENT

Figure 1:
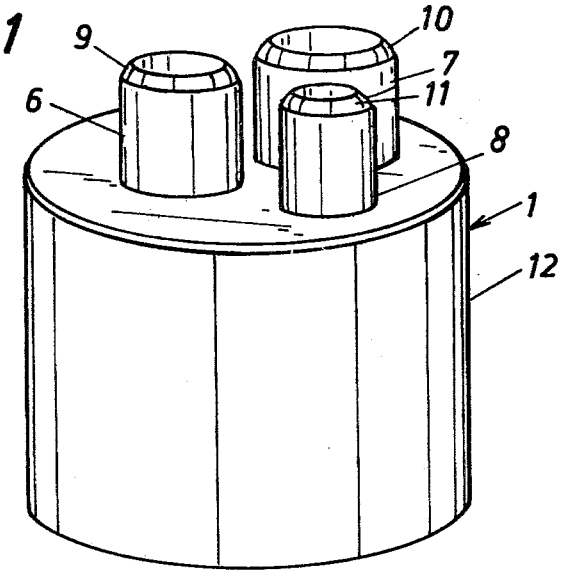
FIG. 1 is a perspective view as seen obliquely from above of a closing cap in accordance with the invention.

The closing cap 1 illustrated in the drawings and made from rubber or some similar elastic material has an upper section 2 into which is moulded a steel plate 5 having three openings 3, 4 therein (only two shown in the drawing). From the upper section extend sleeves 6, 7, 8 which are coaxial with the openings 3, 4 and the upper marginal portions 9, 10, and 11 which taper conically in the direction upwards/inwards. The cylindrical wall 12 of the cap 1 is provided around its middle with a shoulder 13, thus rendering the inner diameter 14 of the upper section 15 of the wall 12 smaller than the inner diameter 16 of the lower wall portion 17 of the cap. In the shown embodiment, diameter 14 is imagined to have a size of 125 mm and diameter 16 a size of 140 mm.

Approximately at the middle of the steel plate 5 a downwardly extending loop 18 is provided, and suspended therein is a hook 19 or similar means arranged at the upper end of a wire or chain 20. At the lower end of the wire or chain 20 a deep well pump, e.g. in the form of an ejector nozzle (not shown), is intended to be suspended.

To the ejector nozzle are connected a tube 21 for supply of pressurized water and one tube 22 to draw up water from the well.

Figure 2:
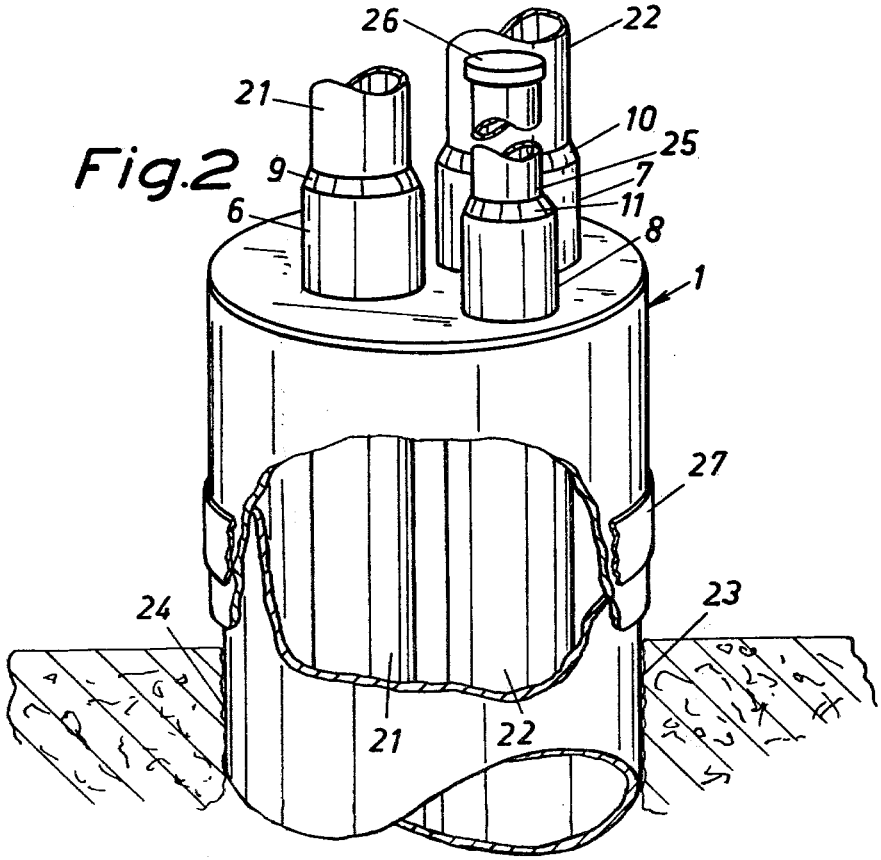
FIG. 2 illustrates said cap mounted on a well casing in a well opening.

FIG. 2 illustrates the upper end of a well casing 24 inserted into a well opening 23, and on the casing a closing cap 1 is mounted. The mounting takes place in the following manner. When the length of the chain 20 has been established, the hook 19 is hooked onto the loop 18. The upper ends of the tubes 21 and 22 from the pump are carried from below upwards through the sleeves 6, 7, whereby the marginal sleeve portions 9 and 10, on account of the resiliency of the rubber material, are pressed into sealing engagement with their associated tube. On the upper ends of each one of tubes 21, 22 are thereafter mounted pipe joints (not shown) for above-ground connection of the tubes. A short venting pipe 25 is passed from below through the sleeve 8 and is then sealed automatically by the resilient marginal portion 11. The upper end of the pipe 25 is provided with a cap 26 which allows air pass-through between the exterior of the pipe 25 and the interior of the cap 26.

Figure 3:
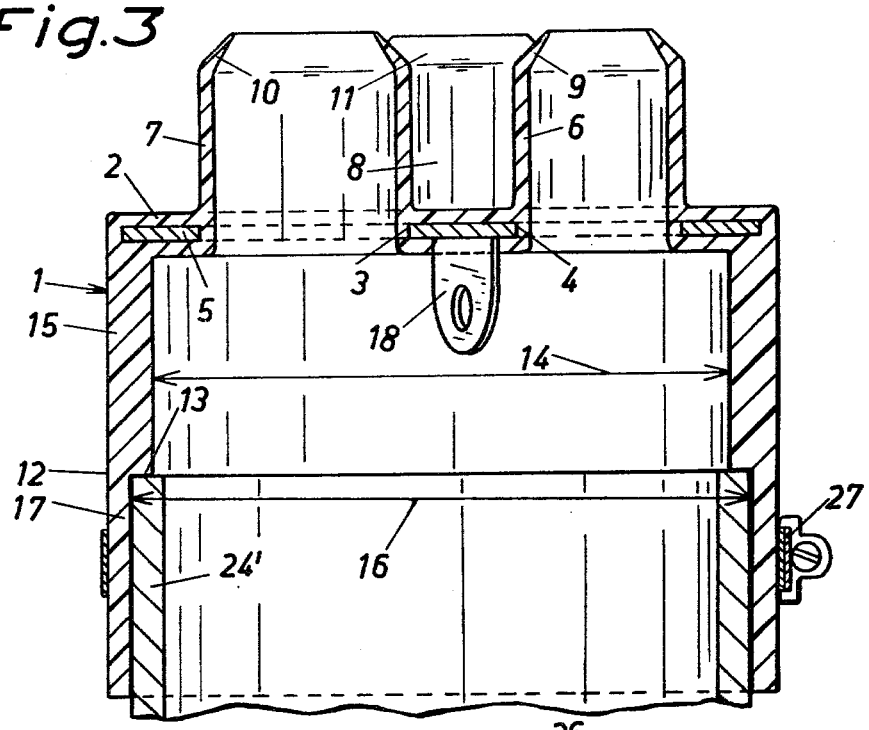
FIG. 3 illustrates on an enlarged scale a vertical longitudinal section through the closing cap mounted on a well casing having a diameter of e.g. 140 mm.
Figure 4:
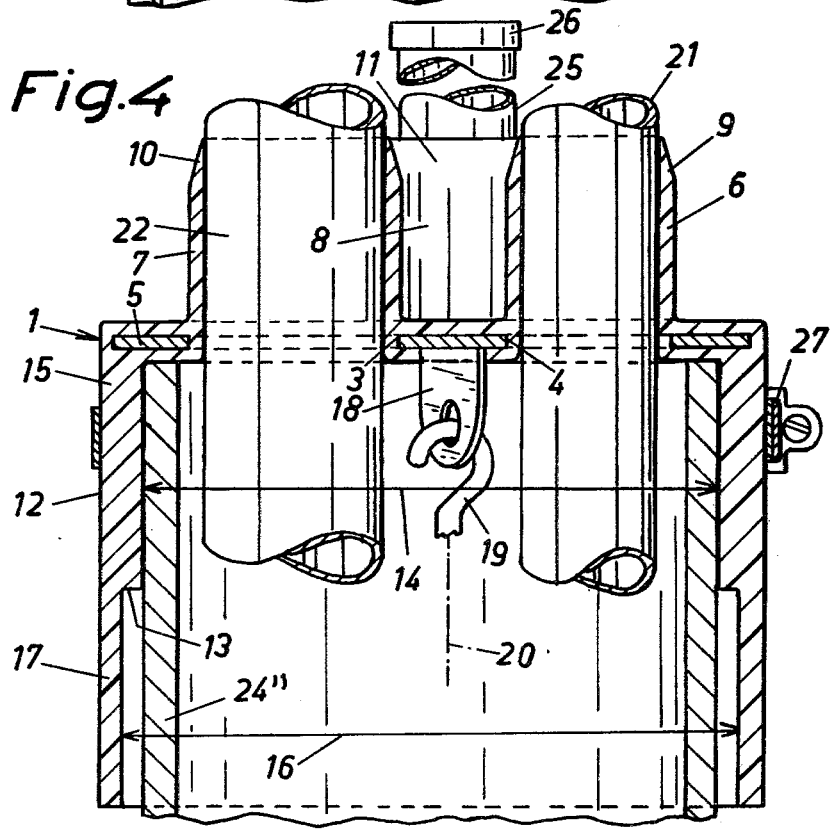
FIG. 4 is a similar section showing the cap mounted on a tube having a smaller diameter, e.g. 125 mm external diameter, and with the tubes to and from the pump extending through the upright sleeves.

A hose clip 27 is provided to tighten the cap wall portion 17 about the larger well casing 14' in accordance with FIG. 3 and with the aid of the same hose clip 27 wall portion 15 in accordance with FIG. 4 is tightened about the smaller well casing 24".

It is thus obvious that the same closing cap 1 can be used with two well casings 24 of different dimensions and that no hose clips are required to provide sealing between sleeves 6, 7 and 8 and their associated tube 21, 22 and the pipe 25.

In the afore-going, it is mentioned that the pump may be in the form of an ejector nozzle. However, it is equally possible to use an electrically driven pump which is submersed in the water in the well. In such cases only one of the tubes, e.g. tube 22 is used to draw up water whereas electrical wiring to the pump is drawn through the tube 21.

What I claim is:

1. An improved closing cap of elastic material to be mounted on and seal the upper end of a well casing, arranged in a well opening, said closing cap comprising a number of sleeves projecting vertically from the upper part of said cap to allow tubes, pipes, conduits, and similar means to pass through said sleeves from a pump provided at the lower part of said well opening, said upper end comprising a steel plate with openings molded therein; and a hose clip to tighten a cap wall portion; the improvement comprising a lower portion of said cap having a first diameter sized to receive a first diameter well casing, the upper portion of said cap being formed with a second diameter smaller than said first diameter and sized to receive a second diameter well casing, an annular shoulder formed on the wall of the cap between said first and second diameters and close to the centre of said cap, said shoulder allowing the lower portion of said cap to be arranged in a sealing position on the first diameter well casing with said first diameter encircling the first diameter well casing and said annular shoulder engaging the upper end of the first diameter well casing in sealing relationship or with said upper portion of said cap arranged in sealing position on the second diameter well casing with said second diameter portion engaging the periphery of the second diameter well casing and a shoulder formed at the upper edge of said upper portion in sealing engagement with the upper edge of the second diameter well casing; said closing cap further comprising a tapering, inwardly bent section on the upper free annular edge portion of each one of said sleeves, said section reducing the internal diameter of this sleeve portion in comparison with the internal diameter of the rest of said sleeve, said free annular edge portions of each one of said sleeves being adapted to be deflected upon passing of the tube, pipe or the like therethrough and for sealing engagement therewith.

* * * * *